United States Patent [19]

Grice et al.

[11] 4,387,293

[45] Jun. 7, 1983

[54] ELECTRIC HEATING APPLIANCE

[75] Inventors: Karl R. Grice, Abbeville; Jimmy L. Bannister; Leland M. Gregory, both of Belton; Frank J. Whitfield, Honea Path, all of S.C.

[73] Assignee: The Belton Corporation, Belton, S.C.

[21] Appl. No.: 248,917

[22] Filed: Mar. 30, 1981

[51] Int. Cl.[3] ..... H05B 3/36

[52] U.S. Cl. ..... 219/529

[58] Field of Search ..... 219/211, 212, 527, 528, 219/529, 535, 545, 549; 338/210; 428/91; 28/116; 112/118, 262.1

[56] References Cited

U.S. PATENT DOCUMENTS

| | | | |
|---|---|---|---|
| 2,203,918 | 6/1940 | Moberg | 219/212 |
| 2,393,182 | 1/1946 | Newell | 219/212 |
| 2,696,549 | 12/1954 | Sturtevant | 219/212 |
| 2,706,768 | 4/1955 | Kaplan | 219/212 |
| 2,708,234 | 5/1955 | Kerr | 338/254 |
| 2,708,235 | 5/1955 | Kaplan | 219/212 |
| 2,710,909 | 6/1955 | Logan et al. | 219/528 X |
| 2,722,951 | 11/1955 | Keily et al. | 139/410 |
| 2,961,526 | 11/1960 | Dykes | 219/529 |
| 3,028,477 | 4/1962 | Rusell, Jr. | 219/212 X |
| 3,064,332 | 11/1962 | Kaplan | 29/611 |
| 3,096,428 | 7/1963 | Dublirer et al. | 219/529 |
| 3,102,186 | 8/1963 | Owers | 219/212 |
| 3,119,926 | 1/1964 | Mills et al. | 219/212 |
| 3,130,289 | 4/1964 | Katzman et al. | 219/528 X |
| 3,385,246 | 5/1968 | Schlegel | 112/118 |
| 3,431,611 | 3/1969 | Rentz | 28/112 |
| 3,470,350 | 9/1969 | Lewis | 219/211 |
| 3,745,301 | 7/1973 | Sherrill et al. | 219/212 |
| 3,960,095 | 6/1976 | Story | 112/118 |
| 3,973,066 | 8/1976 | Smith et al. | 428/91 |
| 4,006,697 | 2/1977 | Robertson | 112/118 |
| 4,139,763 | 2/1979 | McMullan et al. | 219/528 |

FOREIGN PATENT DOCUMENTS

| | | | |
|---|---|---|---|
| 2,393,182 | 1/1946 | ell | 212/ |

*Primary Examiner*—Volodymyr Y. Mayewsky
*Attorney, Agent, or Firm*—Jones & Askew

[57] ABSTRACT

An electric heating appliance such as an electric comforter and a method of manufacturing the same in which two inner thermal insulation layers of resilient fiber fill material, one of which has substantially greater thermal conductivity than the other, and two outer textile fabric layers are stitched together along parallel spaced lines arranged in pairs of rows to form a shell with a series of laterally spaced channels in which are disposed an electric heating wire. Each inner thermal insulation layer has facing means on its inner surface to facilitate insertion of the heating wire into the channels and to resist penetration of the heating wire into the layer. Successive shells may be formed in a continuous manner by passing webs of the outer and inner layers in juxaposed relationship through a multi-needle stitching machine which stitches the webs together with groups of spaced parallel rows of stitching. The stitching of a central main area of the webs is intermittently interrupted to provide seriatim sets of rows of stitching separated at their respective ends by unstitched areas. The stitched together webs are transversely cut along lines passing through the respective unstitched areas to provide successive shells each with the channels thereof open at their respective ends for subsequent insertion of the heating wire into the channels.

8 Claims, 7 Drawing Figures

ELECTRIC HEATING APPLIANCE

BACKGROUND OF THE INVENTION

This invention related generally to the electrically heated appliances such as electric comforters, and more particularly is directed to an improved electric comforter which can be economically manufactured and to the method of manufacturing the same.

Electric blankets have found wide acceptance as a topmost bed covering and generally comprise a two-ply woven cloth shell having channels in which are located a heating wire and safety thermostats connected thereto. Electric blankets of this type are disclosed in the following U.S. Pat. Nos.: 2,203,918 Mosberg June 11, 1940; 2,393,182 Newell Jan. 15, 1946; 2,722,951 Keily et al. Nov. 8, 1955; 2,961,526 Dykes Nov. 22, 1960.

Some electric blankets also have been constructed with shells comprising two plies of textile fabric united to each other at spaced points along parallel lines to form channels. A blanket shell which is made by stitching together two plies of fabric is shown in the Kerr U.S. Pat. No. 2,708,234 issued May 10, 1955. Other blanket shells have been formed by needle laminating two plies of fabric along spaced parallel bands as shown in the Rentz U.S. Pat. No. 3,431,611 issued Mar. 11, 1696.

Electric blankets serve as excellent, low cost bed covering for many people under ambient temperatures in the range of 60° F. to 75° F. However, bedroom temperatures well below 60° F. are becoming increasingly common as people lower thermostat settings of their home heating systems at night to reduce energy costs. At temperatures below 60° F., the value of the heating and insulating characteristics of the electric blanket begin to diminish for many users of electric blankets. As these characteristics diminish, users tend to place additional covering over the electric blanket to supplement its insulating characteristics. In doing so, the user is placing the electric blanket heating system in a "safety only" operating mode. The safety thermostats incorporated in a blanket to prevent overheating actually become the temperature control elements, and the control provided to control the blanket temperature becomes superfluous to blanket operation. When operating in this mode, the electric blanket temperature will stop rising when the temperature of the safety thermostat with the lowest calibrated temperature is exceeded. The electric blanket thus operates in an overheating mode which can be detrimental to the heating wire and safety thermostats. Misuse of this type is a frequent cause of electric blanket failure.

A quilted bedcovering such as a comforter provides better thermal insulation than does a blanket, and it has been recognized that an electrically heated comforter would be a desirable bedcovering. Examples of electric comforter construction which have been proposed in the past are disclosed by the following U.S. Pat. Nos.: 2,706,768 Kaplan April 19, 1955; 2,708,235 Kaplan May 10, 1955; 3,064,332 Kaplan Nov. 20, 1962; 3,102,186 Owers Aug. 27, 1963.

The electric comforter constructions shown in the Kaplan U.S. Pat. Nos. 2,706,768 and 2,708,235 are unsuitable for economical mass production. The comforter construction shown in the Kaplan U.S. Pat. No. 3,064,332 is better suited for mass production but has a serious shortcoming in that the heating wire is not positively positioned in the intermediate ply of insulating material. Besides being unsuitable for economical mass production, the electric comforter of the Owers U.S. Pat. No. 3,102,186 requires the use of thermoplastic insulating pads and apparently would not have the customary appearance and feel of the usual quilted comforter.

The continuous manufacture of comforters and other quilted fabrics with multi-needle stitching means is generally well known, and the use of such machines to produce an electric blanket shell is suggested in the above mentioned Kerr U.S. Pat. No. 2,708,234. Examples of such multi-needle stitching machines are shown in the following patents, the disclosures of which are incorporated herein by reference: 3,385,346 Schlegel May 28, 1968; 3,960,095 Story June 1, 1976; 4,006,697 Robertson Feb. 8, 1977.

SUMMARY OF THE INVENTION

Accordingly, the general object of the present invention is to provide a new electric heating appliance construction and a method of making the same which eliminates or minimizes deficiences and problems encountered heretofore as discussed hereinabove.

In accordance with an aspect of this invention, the shell for an electric heating appliance comprises two outer layers of textile fabric and two inner thermal insulation layers of resilient nonwoven fiber fill material all connected together by elongated rows of stitching passing through all layers and extending along spaced parallel lines. More specifically, the rows of stitching extending throughout a major portion of the shell are arranged in pairs of rows to form a series of parallel dividers and channels between the inner layers with adjoining channels separated by two rows of stitching. The channels are open at their ends to allow subsequent insertion and passing of an electric heating wire back and forth through the channels. Facing means are located at the inner surfaces of each of the inner layers to facilitate such insertion of the heating wire into the channels and to resist penetration of the heating wire into the inner layers. The facing means preferably are provided by permeating the inner surface of each inner layer with a synthetic resin binder which bonds the fibers thereof together. Alternatively, the facing means may comprise two innermost layers of scrim fabric interposed between the two inner layers.

Also according to the present invention, one of the inner thermal insulation layers is of no more than one half the thickness of the other inner layer so as to have substantially greater thermal conductivity to the heat provided by a heating wire inserted into the channels. This provides a heated zone externally of the shell adjacent the inner layer of reduced thickness in an electrically heated appliance constructed with the shell. In a preferred embodiment of one aspect of the invention, the inner layer of reduced thickness is formed of nontubular polyester fibers and has weight on the order of three ouncess per square yard while the other inner layer is formed of tubular polyester fibers and has a weight on the order of six ounces per square yard.

In accordance with a particular embodiment of one aspect of the invention, a method of manufacturing an electric heating appliance having a heating wire disposed in the channels of a flexible fabric shell unit includes the step of forming successive shell units in a continuous manner from two outer webs of textile fabric material and two inner thermal insulation webs of a resilient nonwoven fiber fill material. The inner surfaces of the inner webs are each permeated with a synthetic resin bonding together the fibers thereof, and the thickness of one inner web is no more than one half the thickness of the other inner web so as to have substantially greater thermal conductivity. More specifically, the four webs are brought together in substantially coplanar relationship and passed in juxtaposed relationship through a multi-needle stitching machine having a plurality of needles spaced with respect to each other for forming spaced parallel rows of stitching extending lengthwise in the direction of movement of the webs. As the webs pass through the stitching machine, they are all stitched together in marginal portions of substantial width at the lateral edges thereof along respective first and second groups of continuous parallel lines. Simultaneously, all the webs are stitched together in a main area thereof intermediate the marginal portions along a third group of parallel lines which are arranged in pairs of rows to form a series of parallel dividers and channels between the inner webs with adjoining channels separated by two rows of stitching. The stitching of the webs along the third group of lines is intermittently interrupted to provide seriatim sets of rows of stitching separated at their respective ends to define an unstitched area in the webs between the ends of successive ones of these sets of rows of stitching, the lengths thereof being somewhat less than the length of the shell unit being formed and selected ones of the dividers being staggered longitudinally relative to each other so as to have alternate long and short end portions disposed toward the unstitched areas. As the webs pass through the stitching machine, the stitched webs may be transversely cut along a line spaced from the ends of the dividers in successive unstitched areas to provide shell units with the channels thereof open at their respective ends. Each of these shell units is then wired by threading an electric heating wire through at least some of the channels between the inner webs so as to be distributed in a series of convolutions throughout a main area thereof with the heating wire having loops extending about the short end portions of the dividers into adjacent channels. After each shell unit is wired, the ends thereof are closed by stitching together the webs.

For a better understanding of the invention, reference may be had to the following detailed description taken in connection with the accompanying drawings, in which:

DESCRIPTION OF THE PREFERRED EMBODIMENT

Figure 1:
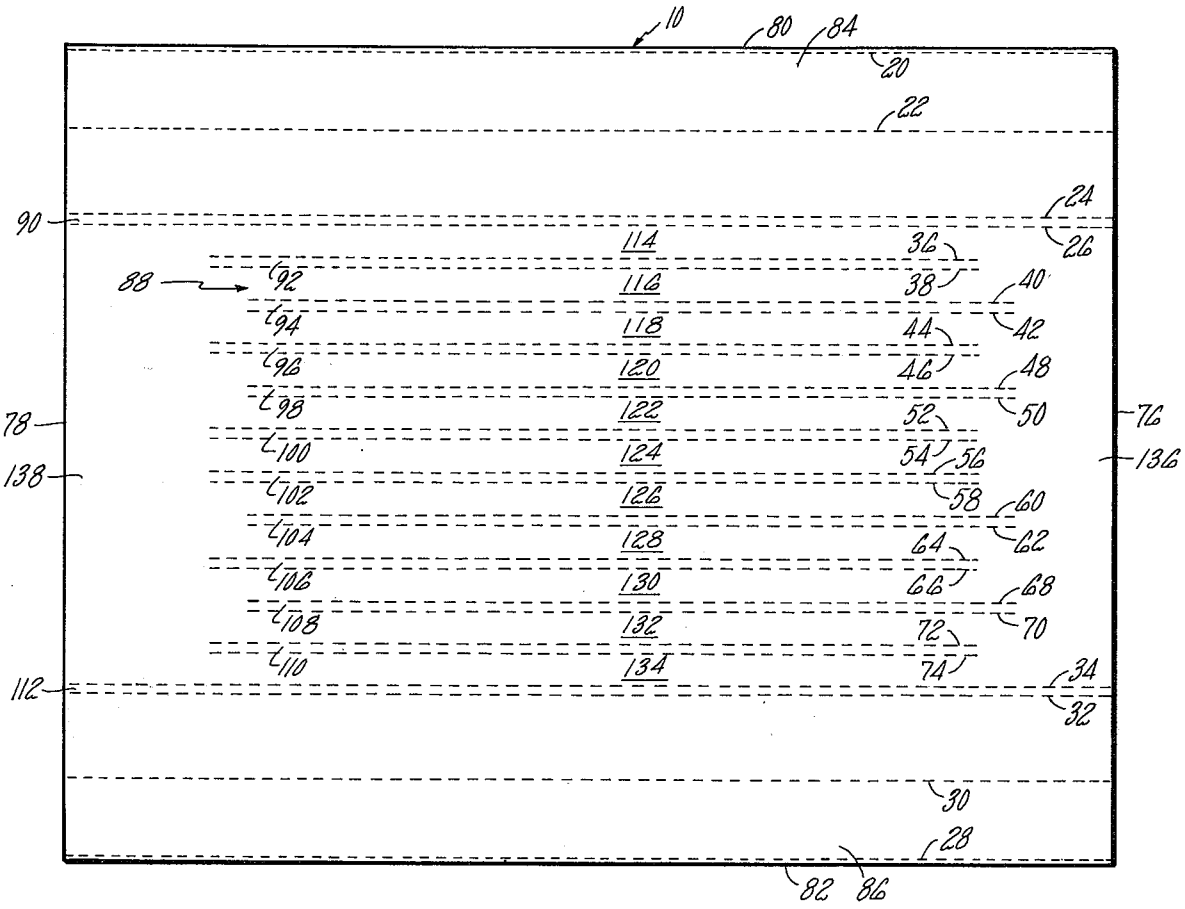
FIG. 1 is a plan view of a shell for an electrically heated appliance according to the present invention.
Figure 2:
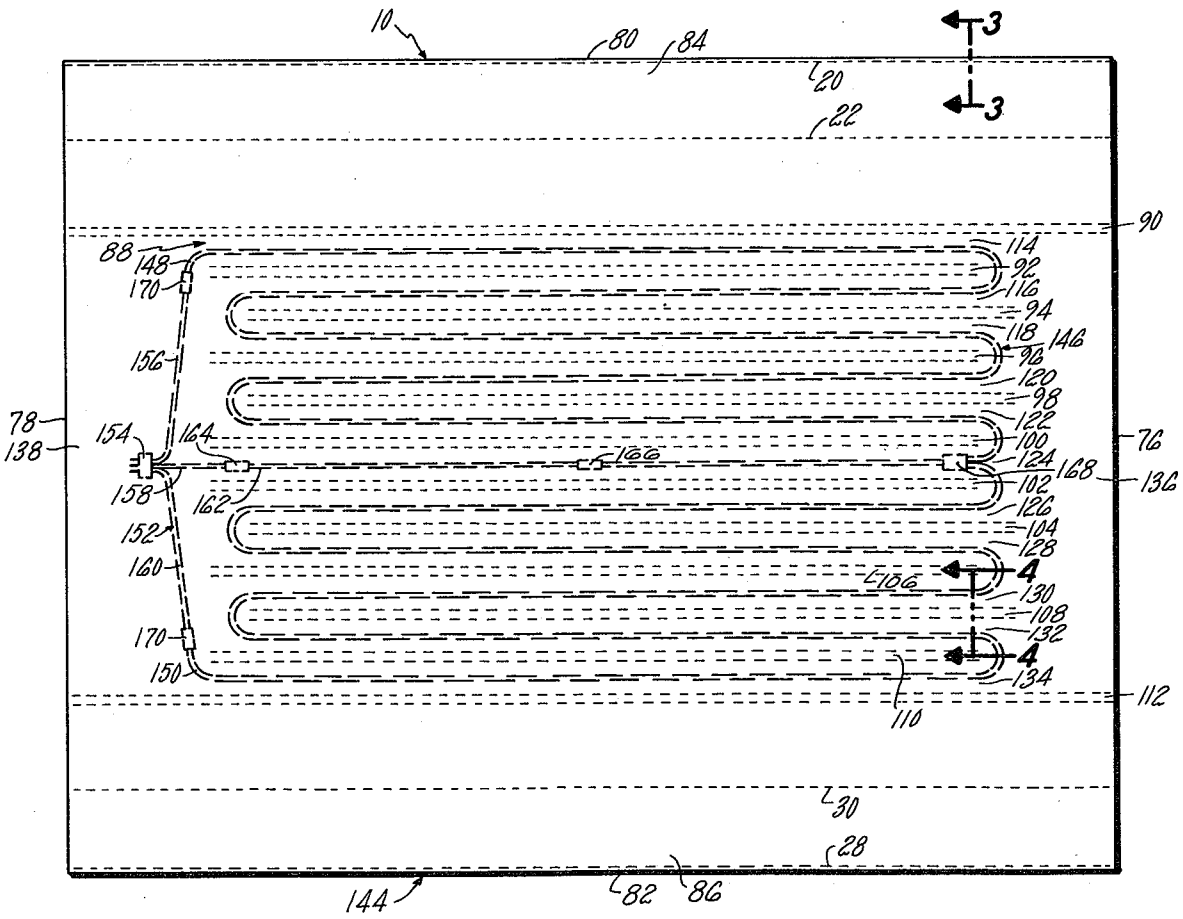
FIG. 2 is a plan view of a completed electrically heated appliance embodying the present invention.
Figure 3:
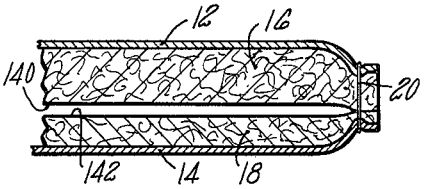
FIG. 3 is an enlarged sectional view taken along line 3—3 of FIG. 2.
Figure 4:
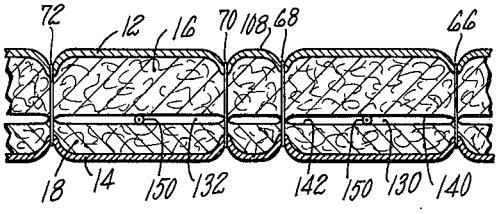
FIG. 4 is an enlarged sectional view taken along line 4—4 of FIG. 3.
Figure 5:
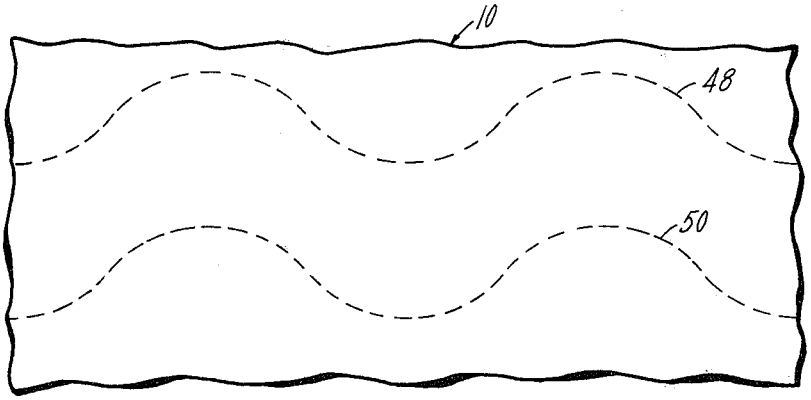
FIG. 5 is an enlarged fragmentary view of a portion of the shell of FIG. 1 showing portions of two adjacent rows of stitching.

Referring now to the drawings and first considering FIGS. 1–5, a flexible fabric shell 10 embodying the present invention comprises two relatively thin outer or cover layers 12 and 14 of textile fabric material and two relatively thicker thermal insulation layers 16 and 18 of resilient non-woven fibers. These four layers or plies are connected together along spaced generally parallel lines by elongated rows 20–74 of stitching passing through the layers. Although the rows of stitching 20–74 are shown in FIGS. 1 and 3 as being stitched in straight lines, it will be apparent that they may be stitched in other forms of lines such as the wavy or sinuous lines illustrated in FIG. 5.

The shell 10 has a head edge 76, a foot edge 78, and two lateral edges 80 and 82. The rows of stitching 20–74 extend transversely of the edges 76 and 78 with one group of rows 20–26 distributed over the marginal portion 84 at the lateral edge 80 and another group of rows 28–34 distributed over the marginal portion 86 at the other lateral edge 82. The rows of stitching 20, 22, 24 and 28, 30, 32 may be uniformly spaced at seven inch intervals, for instance, and all the rows 20–34 preferably extend continuously between the edges 76 and 78. These rows of stitching 20–34 preferably should be tack stitched adjacent their respective ends. A further group of rows 36–74 have their respective ends spaced from the edges 76 and 78 and are distributed over a main portion or main body area 88 of the shell 10. These rows 36–74, together with the rows 24, 26 and 32, 34 are arranged in pairs with the two rows of each pair being generally coextensive and spaced about one inch from each other. These relatively closed spaced rows of each pair provide a series of parallel dividers 90–112 between the inner layers 16 and 18 which define parallel channels 114–134 which are open at their respective ends. Each channel may be approximately three inches wide and is separated from an adjoining channel by the two rows of stitching forming the intermediate divider. The dividers preferably should be tack stitched at the respective ends of the rows 36–74. It will be noted that most of the dividers are staggered longitudinally relative to each other so as to have alternate short portions disposed toward the unstitched areas 136 and 138 of the shell 10 adjacent respective edges 76 and 78. This staggered arrangement of the dividers serves to ensure that adjacent lengths of electric heating wire subsequently inserted through the channels will not touch each other or other wiring disposed in the shell.

The upper and lower layers 12 and 14 may be of any suitable woven textile fabric normally used in bedcoverings, preferably polyester fabrics. The upper layer 12 may be chosen primarily for its aesthetic appeal but the lower layer 14 desirably should be a firm fabric to ensure position stability on a bed of an electrically heated appliance constructed from the shell 10. The inside fill or inner layers 16 and 18 each comprise resilient nonwoven fiber fill materials of the type normally used as thermal insulation fill in sleeping bags and comforters.

According to an important feature of the present invention, the inner layer 18 has substantially greater thermal conductivity than the inner layer 16. Thus the heat generated by the heating wire subsequently inserted through the channels will be conducted for the most part through the lower inner layer 18 thereby providing a heating zone externally of the shell 10 adjacent to the inner layer 18. A desirable difference in thermal conductivity between the two layers 16 and 18 may be effected by having the inner layer 18 at most one half the thickness of that of the other inner layer 16. An additional difference in thermal conductivity can be effected by employing an inner layer 16 of tubular fibers and an inner layer 18 of non-tubular fibers. The tubular fibers in the upper inner layer 16 provide considerably greater loft than non-tubular fibers resulting therefore in increased dead air space for greater thermal insulating capacity. According to a preferred embodiment of the invention, the upper inner layer 16 consists of a six ounce per yard fill material of tubular polyester fibers marketed by the Eastman Kodak Company under the trademark "EASTMAN KODEL 435 KODOFILL," and the lower inner layer 18 consists of a three ounce per yard fill material of non-tubular polyester fibers marketed by the Eastman Kodak Company under the trademark "EASTMAN 431 KODEL." Although the inner layers 16 and 18 preferably each comprise a single layer of thermal insulation material, it will be apparent that either or both could be of a multilayer construction, if desired.

Another important feature of the present invention is the provision of facing means at the inner surfaces of each of the inner layers 16 and 18 to facilitate insertion of a heating wire through the channels and to resist penetration of the heating wire into either of the layers 16 and 18. Such facing means are designated by reference numerals 140 and 142 in FIGS. 2 and 4, any may comprise an acetate, acrylic or other synthetic resin binder respectively permeating the inner surfaces of the layers 16 and 18 and binding together the fibers thereof at these inner surfaces. Alternatively, the facing means 140 and 142 may comprise two innermost layers of scrim fabric or any other suitable woven or non-woven fabric, but it should be recognized that such layers are not nearly as effective as the resin binder facing means in precluding the tendency of a heating wire to slip or migrate with respect to the shell 10.

One form of an electrically heated appliance such as an electric comforter constructed with the shell 10 is shown in FIG. 2 and is indicated generally by the reference numeral 144. The comforter 144 includes an electric heating wire 146 which is threaded through the channels 114–134 of the shell so as to be distributed in a series of convolutions throughout the main area 88. The heating wire 146 may comprise two main heating sections 148 and 150 and a harness assembly 152. Sections 148 and 150 of the heating wire 146 extend respectively through the sets of channels 114–122 and 126–134 and have loops extending about the respective short end portions of the dividers 92–110. The harness assembly 152 includes an electrical connector plug 154, three wire sections 156, 158 and 160 leading from the plug 154, and a thermostat section 162 connected to the wire section 158. The plug 154 may be of the construction disclosed in the Sturtevant U.S. Pat. No. 2,696,549 issued Dec. 7, 1954 and may be securely anchored to the shell 10 in the fashion disclosed by the latter patent. The thermostat section 162 has connected therein three safety thermostats 164, 166 and 168 of the type commonly used in electric blankets and extends through the channel 124. Each of the main heating sections 148 and 150 are connected at one end to the thermostat 168 and are connected at their other ends respectively to the wire sections 156 and 158 by an insulated splice connector 170.

All sections of the heating wire 146 should be electrically insulated with a synthetic resin coating at least 0.02 inch thick and having a temperature rating of at least 90° C. For the "twin size" comforter shown in FIG. 2, the heating wire 146 should have a resistance value which will dissipate about 50 watts of electric power when energized so as to provide adequate heating at temperatures as low as 40° F. In electric comforters of sizes commonly used for bed coverings, the main heating sections 148 and 150 will have a resistance value in the range of 11 to 20 ohms per foot. The resistance values of the other sections should be substantially lower such as about 3 ohms per foot for the thermostat section 162 and about one ohm per foot for the wire sections 156, 158 and 160. Because the electric comforter 144 requires less electric heat for comfort than an electric blanket of similar size, the safety thermostats 164, 166 and 168 may be calibrated to open at temperatures lower than the calibration temperatures commonly employed for safety thermostats of electric blankets.

After the heating wire 146 has been inserted into the shell 10, the ends of the shell may be closed by stitching the layers 12–18 together along the head edge 76 and the foot edge 78. If not previously closed during manufacture of the shell 10, the sides of the shell also may be closed at this time by stitching the layers 12–18 together along the lateral edges 80 and 82. A lock stitch type serging is preferably used for this purpose but suitable binding material could be secured to the edges in a conventional manner. It will be noted that although the heating wire 146 is not disposed in the unstitched areas 136 and 138 at the respective head and foot edges 76, 78, these areas being unstitched will have greater loft than the stitched heated areas to provide better heat insulation and retention.

Figure 6:
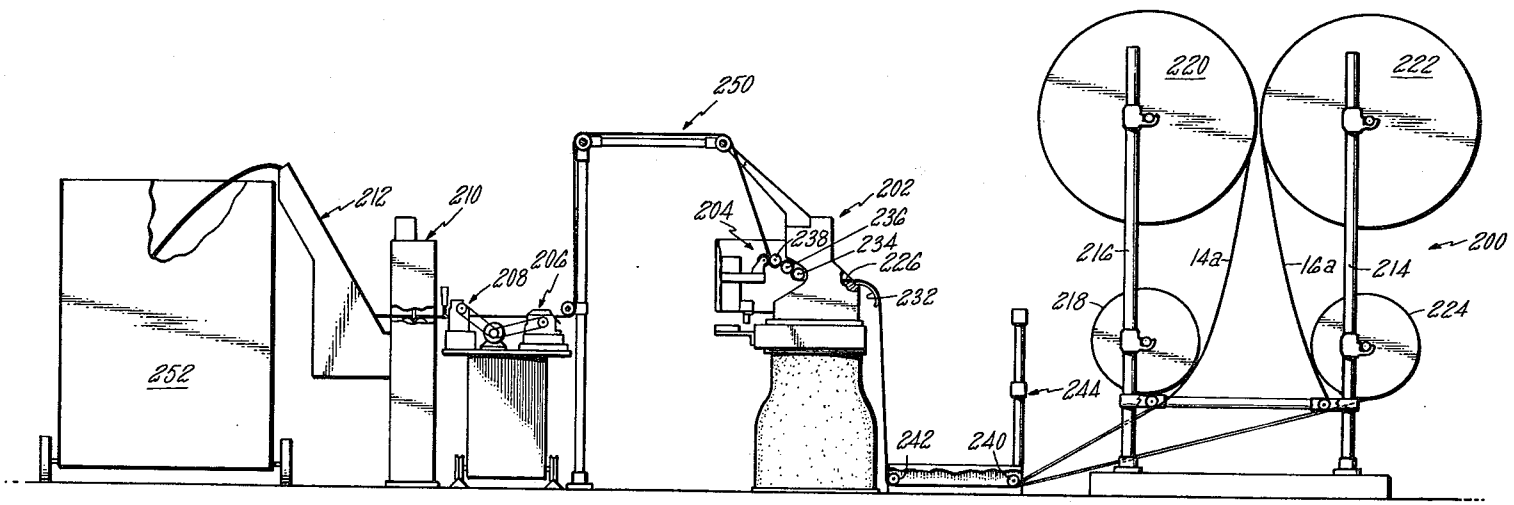
FIG. 6 is a side elevation of apparatus for forming successive shell units in a continuous manner.
Figure 7:
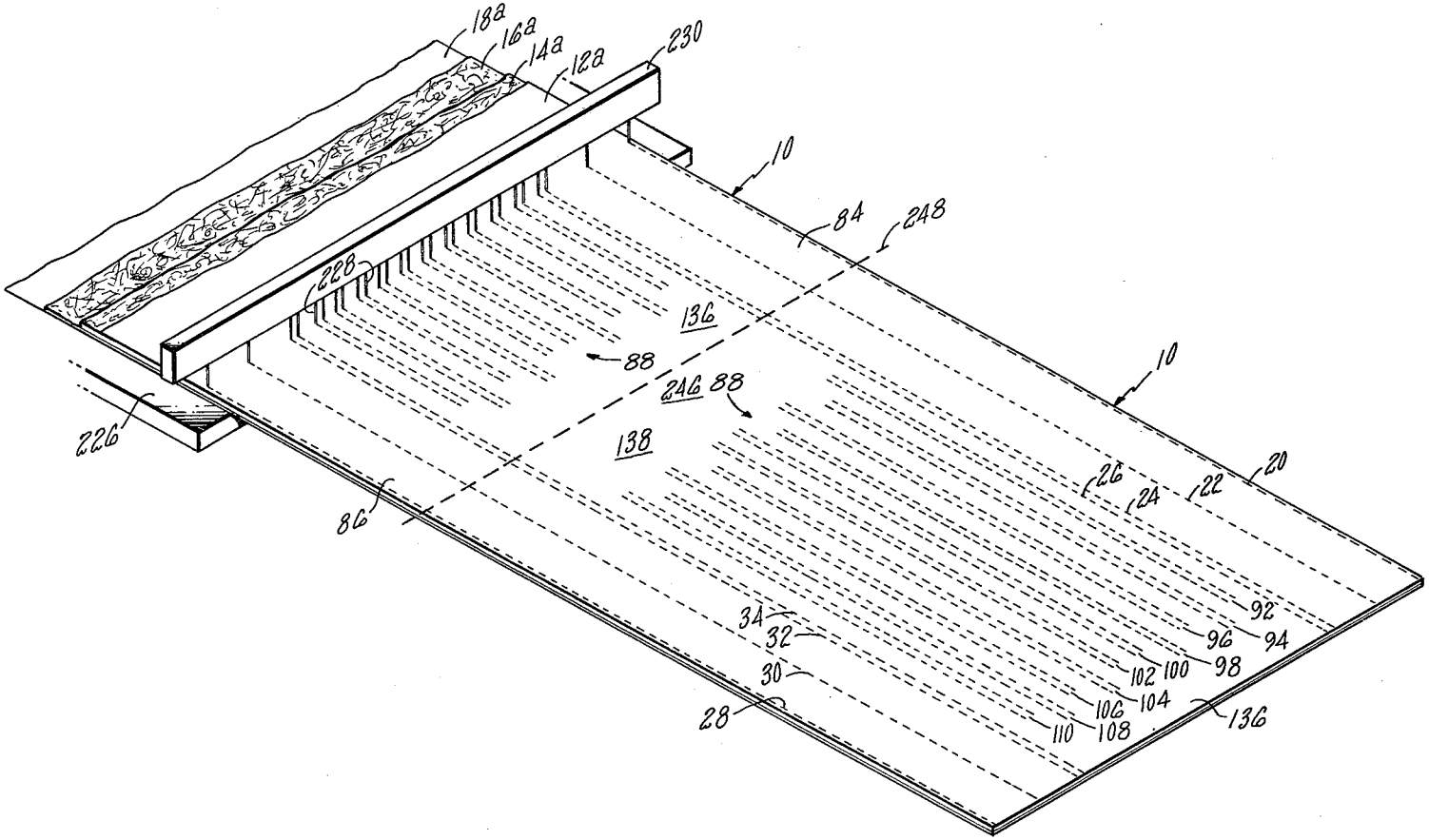
FIG. 7 is a somewhat schematic perspective view illustrating a method embodying the present invention for forming successive shell units in a continuous manner.

Referring next to FIGS. 6 and 7, there is illustrated diagrammatically one form of apparatus which may be employed to carry out a method for manufacturing electrical appliance in accordance with the present invention. This apparatus includes a material carriage 200 and a multi-needle stitching machine 202 which may be provided with two side trimming attachments, one of which is shown at 204. The apparatus may further include two serging units, one of which is shown at 206, a material puller assembly 208, a cutter assembly 210, and a belt conveyor 212. The material carriage 200 may comprise pedestals or uprights, two of which are shown at 214 and 216, for rotatably supporting rolls 218, 220, 222 and 224 of the respective materials comprising the previously described layers 12, 14, 16, 18. If more convenient, the rolls 218 and 224 could be located immediately adjacent the stitching machine 202 on a suitable supporting structure (not shown).

As illustrated in FIG. 7, the stitching machine 202 includes a table 226 and a plurality of vertically reciprocable needles 228 arranged in one or more lateral rows above the table 226 with each row of needles 228 attached to an elongate head or needle bar 230. As can be seen from FIG. 6, the stitching machine 202 also includes an apron 232 adjacent the table 226 and three drawing rolls 234, 236, and 238 for drawing material to be stitched over the apron 232 to the table 226. Multi-needle stiching machines are well known and reference may be had to the aforesaid U.S. Pat. Nos. 3,385,246; 3,960,095; and 4,006,697 for a fuller description of such machines. Multi-needle stitching machines particularly suited to the practice of the present invention are available from Gribetz & Co., Inc. of Hallendale, Fla.

In the manufacture of shells or shell units 10 with the apparatus of FIGS. 6 and 7, webs 12*a*, 14*a*, 16*a* and 18*a* of the respective materials comprising the previously described layers 12, 14, 16 and 18 are drawn from respective supply rolls 218, 220, 222, and 224. As the webs 12*a*, 14*a*, 16*a* and 18*a* pass around rollers 240 and 242 on an operator platform 244, they are brought together in substantially coplanar relationship and then pass in juxtaposed relationship over the apron 232 to the table 226 and under the needles 228 of the stitching machine 202. As they pass through the stitching machine 202, all the webs are stitched together in the marginal portions 84 and 86 along a first group of continuous parallel spaced lines to form the rows of stitching 20–26 and along a second group of continuous parallel spaced lines to form the rows of stitching 28–34. While the webs are being stitched together in the marginal portions, they are simultaneously stitched together in the main portion 88 intermediate the marginal portions along a further group of parallel spaced lines to form the rows of stitching 36–74 shown in FIG. 1. Because these rows 36–74 are arranged in pairs with the two rows of each pair relatively closely spaced, they are identified in FIG. 7 by the dividers 92–110 which they define.

The stitching of the webs 12*a*, 14*a*, 16*a* and 18*a* along the further group of lines where the rows of stitching 36–74 are located is intermittently interrupted to provide seriatim sets of these rows of stitching separated at their respective ends to define an unstitched area 246 between the ends of successive ones of the sets of dividers 92–110. At the start and finish of these rows of stitching 36–74, the ends of the rows are tack stitched by the stitching machine 202. It will be observed that the stitching of certain pairs of these rows of stitching is stopped and resumed at slightly different interval than for other pairs of these rows to provide the previously described staggered arrangement of the dividers 92–110.

Successive shells or shell units 10 are formed in a continuous manner as the webs 12*a*, 14*a*, 16*a* and 18*a* are passed through the stitching machine 202. After the stitched assembly of webs leaves the drawing roll 238, it is trimmed to the desired width by the trimming attachments 204 if such trimming is necessary and then passes over an overhead canopy assembly 250 to the serging units 206 where the lateral edges 80 and 82 are closed by stitching the webs together with a lock stitch type serging. The stitched assembly of webs 12*a*, 14*a*, 16*a* and 18*a* is drawn by the material pulling assembly 208 from the serging units 206 through the cutter assembly 210. Here the shell units 10 are separated from each other by transversely cutting the stitched together webs along a line as indicated by the dashed line 248 in FIG. 7 which passes through the unstitched area 246 and is spaced from the ends of the dividers 92–110. When thus severed, each shell unit 10 has unstitched areas 136 and 138 at its respective opposite ends in which the channels 114–134 are open at their respective ends to permit wiring of the shell unit 10. As each successive shell unit 10 passes through the cutter assembly 210, it is carried by the belt conveyor 212 to the open top of a transport cart 252 or other suitable receptacle in which the completed shell units 10 may be deposited.

To wire the shell unit 10, the connector plug 154 is securely stitched to the shell unit 10 at the foot end portion and the heating wire 146 is threaded through the channels 114–134. The section 162 of the heating wire 146 with the safety thermostat 168 at its free end is inserted into the channel 124 from the foot edge portion. The heating section 148 is inserted into the channel 114 and then passed through successive ones of the channels 116–122. The other heating section 150 is similarly inserted into the channel 134 and then passed through the channels 126–132. The sections of the heating wire 146 may be carried upon and unwound from a shuttle (not shown) or other suitable implement. It will be apparent that the provision of the facing means 140 and 142 on the respective inner surfaces of the inner layers 16 and 18 facilitate insertion of the heating wire 146 through the channels with such an implement. Thereafter, the ends of the heating sections 148 and 150 are connected to the end of the wire section 162 and this connection is electrically insulated in a sealed manner. After wiring of the shell unit 10 is completed, the ends of the shell unit 10 are closed by stitching the webs 12*a*, 14*a*, 16*a* and 18*a* together with a lock stitch type serging or other suitable means.

In view of the forgoing, it will be seen that the electrically heated appliance or electric comforter of the present invention couples the superior termal insulation characteristics of polyester fill materials with an electric heating element similar to that used in electric blankets to provide comfort and warmth at room temperatures below 50° F. The thermal insulation properties alone, without any auxiliary heat supplied by the heating wire, provides ample warmth for a majority of users at 60° F. or even lower room temperatures. The electric comforter has heating characteristics superior to those of the electric blanket with only about one-third of the power required for the electric blanket. The lower thermal insulation layer being at most one-half of the thickness of the upper thermal insulation layer and having substantially greater thermal conductivity allows the heat generated by the heating wire to be conducted into and through this lower layer rather than through the upper layer. Thus a heated zone is present at the bottom of the comforter in the vicinity of the heating wire where the heating capacity is desired.

The electric comforter is much less prone to damage through bunching than an electric blanket because the fill material and channel structure maintain considerable spacing between the heating wire sections regardless of how the comforter is folded. The very nature of the comforter, as compared with a blanket, results in substantially increased resistance to almost any form of bunching. Attempts to bunch the comforter almost invariably result in recovery from the bunching as soon as the bunching pressure is released.

The previously described divider and channel arrangement, together with the facing means on the thermal insulation layers of the shell ensures position stability of the heating wire in the electrically heated appliance or electric comforter of the present invention. Because of the lower operating temperatures in the electric comforter, only three safety thermostats are required for protection against malfunction or excessive heat. To further minimize the possibility of accidental overheating, the safety thermostats may be calibrated to open at temperatures lower than the calibration temperatures commonly used in electric blankets. Since only three safety thermostats are required to adequately protect the electric comforter, there is a significant reduction in the number of thermostats and internal electrical connections as compared to those of a conventional electric blanket. Furthermore, there is no portion of the heating wire crossing any other portion thereof. These features significantly improve the reliability and safety of the electric comforter.

The electrically heated appliance of the present invention can be manufactured far more economically than prior commercial electric comforter constructions. The shells thereof can be produced with automatic multi-needle stitching machines of well-known forms capable of high production. A multi-needle stitching machine can produce typically 50 inches per minute of comforter shell material compared to four inches per minute of woven blanket shell material as fabricated on a loom or weaving machine. Further production advantages result from the prefabrication of the shells which can be subsequently wired in an efficient manner facilitated by the facing means on the thermal insulation layers.

The present invention thus provides an electrically heated appliance of a simple but thermally efficient construction which is characterized by its comfort to the user and its safety and reliability in operation. The present invention further provides an improved method for the manufacture of such electrically heated appliances wherein considerable yardage of the appliance shell material may be economically produced in a continuous manner and fabricated into completed appliances.

While there have been described above the principles of this invention in connection with a specific appliance construction and method of manufacture, it is to be clearly understood that this description is made only by way of example and not as a limitation to the scope of the invention.

What is claimed is:

1. In an electric heating appliance of the type having a flexible fabric shell formed with a series of laterally spaced channels therein and having a heating wire disposed in at least some of said channels, an improved shell construction comprising:

two inner thermal insulation layers of resilient non-woven fiber fill material; one of said inner layers being at most one-half the thickness of the other of said inner layers so as to have substantially greater thermal conductivity;

two outer layers of textile fabric material covering respectively the outer surfaces of said inner layers;

elongated rows of stitching passing through said layers and connecting said inner layers together and to said outer layers along spaced substantially parallel lines to form a shell; said rows of stitching extending throughout a major portion of said shell being arranged in pairs of rows to form a series of parallel dividers between said inner layers with adjacent dividers defining parallel channels therebetween separated from adjoining channels by two rows of stitching; said channels being open at their ends to receive a heating wire; and facing means at the inner surfaces of each of said inner layers to facilitate insertion of a heating wire into said channels and to resist penetration of a heating wire into either of said inner layers.

2. The shell construction of claim 1 wherein said one inner layer is formed of non-tubular polyester fibers and has a weight on the order of three ounces per square yard, and said other inner layer is formed of tubular polyester fibers and has a weight on the order of six ounces per square yard.

3. The shell construction of claim 1 wherein said inner surface of each of said inner layers is permeated with a synthetic resin binder bonding together the fibers thereof to provide said facing means.

4. The shell construction of claim 1 wherein said facing means comprise two innermost layers of scrim fabric interposed between said two inner layers.

5. An electric heating appliance of the character described comprising:

a flexible fabric shell having a head edge portion and a foot edge portion;

said shell including two inner thermal insulation layers of resilient non-woven fiber fill material and two outer layers of textile fabric material covering respectively the outer surfaces of said inner layers;

said inner layers being connected together and to said outer layers by elongated rows of stitching passing through said layers along spaced substantially parallel lines;

said rows of stitching extending throughout a major portion of said shell being arranged in pairs of rows to form a series of parallel dividers between said inner layers extending transversely of said edge portions;

said dividers defining parallel channels therebetween separated from adjoining channels by two rows of stitching and open at their ends;

an electric heating wire extending through said channels for providing a heated shell area;

facing means at the inner surfaces of each of said inner layers to facilitate insertion of the heating wire into said channels and to resist penetration of a heating wire into either of said inner layers; and the lower one of said inner layers being at most one-half the thickness of the upper one of said inner layers so as to have substantially greater thermal conductivity thereby providing a heating zone externally of said shell adjacent said lower inner layer.

6. The electric heating appliance of claim 5 wherein said lower inner layer is formed of non-tubular polyester fibers and has a weight on the order of three ounces per square yard, and said upper inner layer is formed of tubular polyester fibers and has a weight on the order of six ounces per square yard.

7. The electric heating appliance of claim 5 wherein said inner surface of each of said inner layers is permeated with a synthetic resin bonding together the fibers thereof to provide said facing means.

8. The electric heating appliance of claim 5 wherein said facing means comprise two innermost layers of scrim fabric interposed between said two inner layers.

* * * * *

UNITED STATES PATENT OFFICE
CERTIFICATE OF CORRECTION

Patent No. 4,387,293 Dated June 7, 1983

Inventor(s) Karl R. Grice et al

It is certified that error appears in the above-identified patent and that said Letters Patent are hereby corrected as shown below:

Column 9, line 43, immediately after "material;" should be inserted --the lower--.

Column 9, line 59, "and" should be deleted.

Column 10, line 2, immediately after "layer" delete the "." and insert --; and wherein said lower inner layer is formed of non-tubular fibers and said other layer is formed of tubular fibers to provide greater loft and increased dead air space than said non-tubular fibers for greater thermal insulating capacity--.

Column 10, line 3, delete "one" and substitute --lower--.

Column 10, line 4, delete "is formed of non-tubular polyester fibers and".

Column 10, line 6, delete "is formed of tubular polyester fibers and".

Column 10, line 47, immediately after "layer" insert --;and wherein said lower inner layer is formed of non-tubular fibers and said upper inner layer is formed of tubular fibers to provide a greater loft and increased dead air space than said non-tubular fibers for greater thermal insulating capacity--.

Column 10, lines 49-50, delete "is formed of non-tubular polyester fibers and".

Column 10, lines 51-52, delete "is formed of tubular polyester fibers and".

Signed and Sealed this

*Thirty-first* Day of *July 1984*

[SEAL]

*Attest:*

GERALD J. MOSSINGHOFF

*Attesting Officer* *Commissioner of Patents and Trademarks*